US005934894A

United States Patent [19]

Cigler

[11] Patent Number: 5,934,894

[45] Date of Patent: Aug. 10, 1999

[54] APPARATUS FOR STORAGE AND USE OF ROLLED TOBACCO PRODUCTS

[76] Inventor: Kenneth L. Cigler, 2333 43rd St., Two Rivers, Wis. 54241

[21] Appl. No.: 08/880,924

[22] Filed: Jun. 23, 1997

[51] Int. Cl.[6] ..... F23D 11/44; A24F 13/24; A24C 1/24

[52] U.S. Cl. ..... 431/253; 131/249; 131/270; 206/86; 30/112

[58] Field of Search ..... 431/253; 131/249, 131/234, 270, 250, 248, 253; 206/86, 87, 88, 89; 30/112, 111, 113

[56] References Cited

U.S. PATENT DOCUMENTS

| | | | |
|---|---|---|---|
| 815,219 | 3/1906 | Rooll | 206/86 |
| 1,154,158 | 9/1915 | Asendorf, Jr. | 206/86 |
| 1,472,149 | 10/1923 | Bernard | 206/86 |
| 1,757,607 | 5/1930 | Zullo | 206/86 |
| 1,782,026 | 11/1930 | Beyer | 131/249 |
| 1,883,546 | 10/1932 | Campos et al. | 206/86 |
| 1,902,028 | 3/1933 | Heywood | 206/86 |
| 1,928,041 | 9/1933 | Windesheim | 206/86 |
| 2,233,324 | 2/1941 | Palmer | 206/86 |
| 2,572,863 | 10/1951 | Jaap | 131/249 |
| 2,664,091 | 12/1953 | Thostenson | 131/249 |
| 2,777,569 | 1/1957 | Starke, Jr. | 131/249 |
| 3,200,822 | 8/1965 | Meyer | 206/86 |
| 3,888,264 | 6/1975 | Baclit . | |
| 3,976,194 | 8/1976 | Loredo . | |
| 4,000,812 | 1/1977 | Pisarski et al. . | |
| 4,027,682 | 6/1977 | Halmaghi . | |
| 4,190,148 | 2/1980 | Schade, II et al. . | |
| 4,473,084 | 9/1984 | Marshall . | |
| 4,478,230 | 10/1984 | Mazelie . | |
| 4,587,980 | 5/1986 | Tipper . | |
| 4,588,076 | 5/1986 | Caputo et al. | 206/86 |
| 4,625,861 | 12/1986 | Krog | 206/234 |
| 4,660,575 | 4/1987 | Andreason et al. . | |
| 4,703,766 | 11/1987 | Wargo . | |
| 4,774,970 | 10/1988 | Bell . | |
| 4,809,715 | 3/1989 | Musetti . | |
| 4,852,729 | 8/1989 | Conte | 206/86 |
| 4,897,033 | 1/1990 | Yang . | |
| 4,982,746 | 1/1991 | Pruyne . | |
| 4,984,586 | 1/1991 | Nae-Won . | |
| 5,002,073 | 3/1991 | Chiang . | |
| 5,035,250 | 7/1991 | Mazelie . | |
| 5,088,684 | 2/1992 | Torras et al. . | |
| 5,181,528 | 1/1993 | Chen et al. | 131/256 |
| 5,303,721 | 4/1994 | Bowen et al. | 131/248 |
| 5,345,952 | 9/1994 | Nielander . | |
| 5,345,953 | 9/1994 | Taylor . | |
| 5,368,155 | 11/1994 | Ewen . | |
| 5,377,696 | 1/1995 | Goldman . | |
| 5,377,826 | 1/1995 | Ayers et al. . | |
| 5,385,157 | 1/1995 | Smith et al. . | |
| 5,499,634 | 3/1996 | Herrmann . | |
| 5,501,332 | 3/1996 | Ayres et al. . | |
| 5,524,646 | 6/1996 | Reich . | |
| 5,564,443 | 10/1996 | Cardenas . | |
| 5,605,226 | 2/1997 | Hermlein . | |
| 5,643,114 | 7/1997 | Marcus . | |
| 5,664,331 | 9/1997 | Yu | 30/113 |
| 5,694,691 | 12/1997 | Chen | 30/112 |
| 5,722,430 | 3/1998 | Bentley et al. . | |
| 5,727,572 | 3/1998 | Gillie . | |
| 5,738,117 | 4/1998 | Fontaine, Jr. | 131/249 |
| 5,746,587 | 5/1998 | Racine et al. . | |
| 5,752,528 | 5/1998 | Ayres et al. . | |
| 5,759,120 | 6/1998 | Mathis et al. . | |
| 5,778,898 | 7/1998 | Bae et al. . | |
| 5,791,051 | 8/1998 | Schmidt . | |
| 5,806,533 | 9/1998 | Boling . | |
| 5,819,753 | 10/1998 | Birkenthal | 131/248 |

*Primary Examiner*—James C. Yeung
*Assistant Examiner*—David Lee
*Attorney, Agent, or Firm*—DeWitt Ross & Stevens S.C.

[57] ABSTRACT

An apparatus is described which preferably includes a rolled tobacco products cavity for storage of rolled tobacco products, a lighter cavity for receiving a lighter, and a clipping aperture having a cutting door movable thereover to cuts the lengths of rolled tobacco products inserted therein. A refuse cavity may be included in the apparatus adjacent the clipping aperture to store clippings from the rolled tobacco products.

22 Claims, 6 Drawing Sheets

Fig. 11
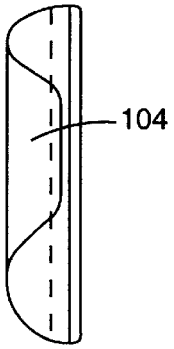
Fig. 12
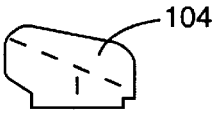
Fig. 13
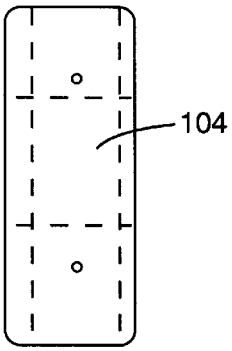
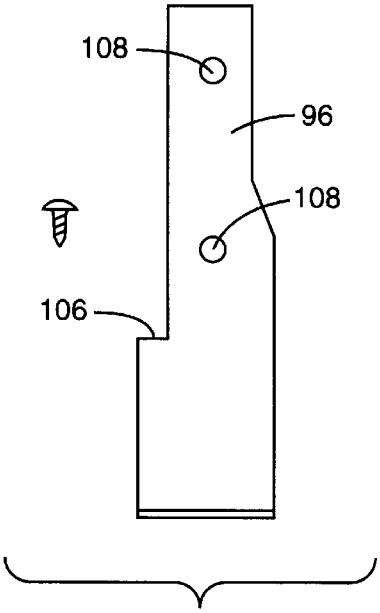
Fig. 14
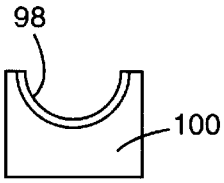
Fig. 15

APPARATUS FOR STORAGE AND USE OF ROLLED TOBACCO PRODUCTS

FIELD OF THE INVENTION

This disclosure concerns an invention relating generally to apparatus for storage and use of rolled tobacco products such as cigarettes and cigars, and more specifically to apparatus for storing rolled tobacco products, providing means for lighting the rolled tobacco products, and also providing means for clipping rolled tobacco products along their lengths.

BACKGROUND OF THE INVENTION

A number of prior apparatus exist for cutting rolled tobacco products (such as cigarettes and cigars) along their lengths for the purpose of providing neatly trimmed ends to serve as mouthpieces for smoking purposes, or to recondition previously ignited ends for later re-lighting. Other apparatus have been provided for storing rolled tobacco products in combination with implements for lighting the products. However, all known apparatus suffer from disadvantages in terms of their ease of use, and they are also not well suited for storage and transportation in one's pocket or purse to allow portable use.

SUMMARY OF THE INVENTION

The invention, which is defined by the claims set out at the end of this disclosure, may be embodied in a variety of different structures. A particularly preferred embodiment of the apparatus has a housing including walls defining a clipping aperture. The clipping aperture is at least partially bounded by a sharp edge, and a cutting door is movably attached to the housing so as to move over the clipping aperture, thereby opening and closing the clipping aperture and forcing any rolled tobacco products inserted within the clipping aperture against the sharp edge to cut the products along their lengths. A lighter is integrally or removably incorporated within the housing so that the base of the lighter is situated adjacent the clipping aperture. The cutting door is preferably spring-biased to maintain it in a normally closed state, and if desired, the sharp edge which cuts the rolled tobacco products may be situated on the cutting door. The cutting door is preferably constrained by the housing to slide along a path situated along at least a portion of the length of the lighter.

The preferred embodiment of the apparatus also includes walls within the housing which define an elongated rolled tobacco products cavity so that a rolled tobacco products receptacle is provided. A cap may be provided to close the rolled tobacco products cavity, and the cap is preferably movably affixed to the housing and is spring-biased to keep the rolled tobacco products cavity in a normally closed state. The same spring used to bias the cutting door into a closed position over the clipping aperture may be used to bias the cap over the rolled tobacco products cavity.

The preferred embodiment of the apparatus also includes walls defining a refuse cavity adjacent the clipping aperture, thereby providing a refuse receptacle wherein cuttings from rolled tobacco products cut by the cutting door may be received and stored. The housing may also include an access door opening onto the refuse cavity to allow cleaning and emptying of the refuse cavity, though a user may instead clean and empty the refuse cavity by accessing it via the cutting door.

In the preferred embodiment of the apparatus, the refuse cavity is preferably situated adjacent the base of the lighter and along a lengthwise axis of the lighter cavity. The rolled tobacco products cavity is preferably adjacent the lighter cavity and is preferably aligned generally parallel to the lighter cavity. The cutting door may be situated between the walls defining the lighter cavity and the walls defining the rolled tobacco products cavity so that it slides therebetween, and also over the clipping aperture.

The most preferred embodiment of the apparatus is compact and easily stored in a pocket or purse; it combines two or more of a lighter receptacle, a rolled tobacco products receptacle, and a rolled tobacco products cutter in a highly space-efficient manner for convenient use; it retains rolled tobacco products in a substantially air and water-tight receptacle to prevent damage or soiling of the products, or the escape of odors from the products; it automatically closes the tobacco products receptacle to prevent accidental release of (and damage to) the tobacco products; it retains cuttings for later emptying to prevent littering; it automatically closes the cutting door to prevent emptying of cuttings into a user's pocket; it provides a cutting door which acts in a direction parallel to the walls of the lighter receptacle, thereby allowing much of the cutting door mechanism to reside within the walls of the apparatus to save space; it retains the cuttings in a substantially air-tight receptacle to prevent the release of odors; it provides an access door to the cuttings receptacle with a unique actuating mechanism requiring both linear and rotational motion to open the access door, thereby reducing the possibility that cuttings may accidentally empty into one's pocket or purse; and it allows the storage and transport of only so many rolled tobacco products as the user desires, rather than packages of products in bulk amounts.

Further advantages, features, and objects of the invention will be apparent from the following detailed description of the invention in conjunction with the associated drawings.

BRIEF DESCRIPTION OF THE DRAWINGS

FIG. 11 is a side elevation view of the finger actuator (104) of FIGS. 3 and 4.

FIG. 12 is a bottom plan view of the finger actuator (104) of FIGS. 3, 4, and 11.

FIG. 13 is a side elevation view of the finger actuator (104) of FIGS. 3, 4, 11, and 12.

FIG. 14 is a side elevation view of the cutting blade (96) of the cutting door (92) of FIGS. 3 and 4.

FIG. 15 is a side elevation view of the wedge (100) of the cutting door (92) of FIGS. 3, 4, 6, and 7.

DETAILED DESCRIPTION OF PREFERRED EMBODIMENTS OF THE INVENTION

Figure 1:
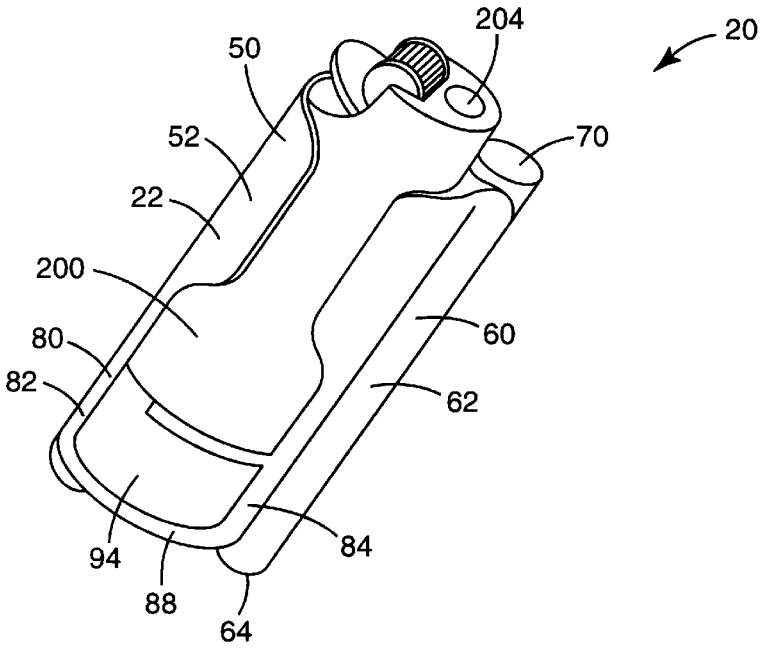
FIG. 1 is a front perspective view of an apparatus embodying a particularly preferred form of the invention.

In the drawings, wherein the same or similar features of the invention are designated in all Figures with the same reference numerals, FIGS. 1–4 illustrate the entirety of a particularly preferred embodiment of the apparatus at the reference numeral 20. The apparatus 20 includes a housing 22 which preferably includes three sections: a lighter section 50 including walls 52 and 54 defining an elongated lighter cavity 56 wherein a lighter 200 may be removably inserted (see particularly FIG. 2); a rolled tobacco products section 60, which includes walls 62 and 64 defining an elongated rolled tobacco products cavity 66 (see particularly FIG. 3); and a refuse section 80 which includes walls 82, 84, 86 and 88 defining a clipping aperture 90 (see particularly FIGS. 2–4), and a cutting door 92 constrained to move over the clipping aperture 90 to open and close the clipping aperture 90 and cut rolled tobacco products inserted therein. Each of the lighter section 50, the rolled tobacco products section 60, and the refuse section 80 will now be discussed in turn.

Figure 2:
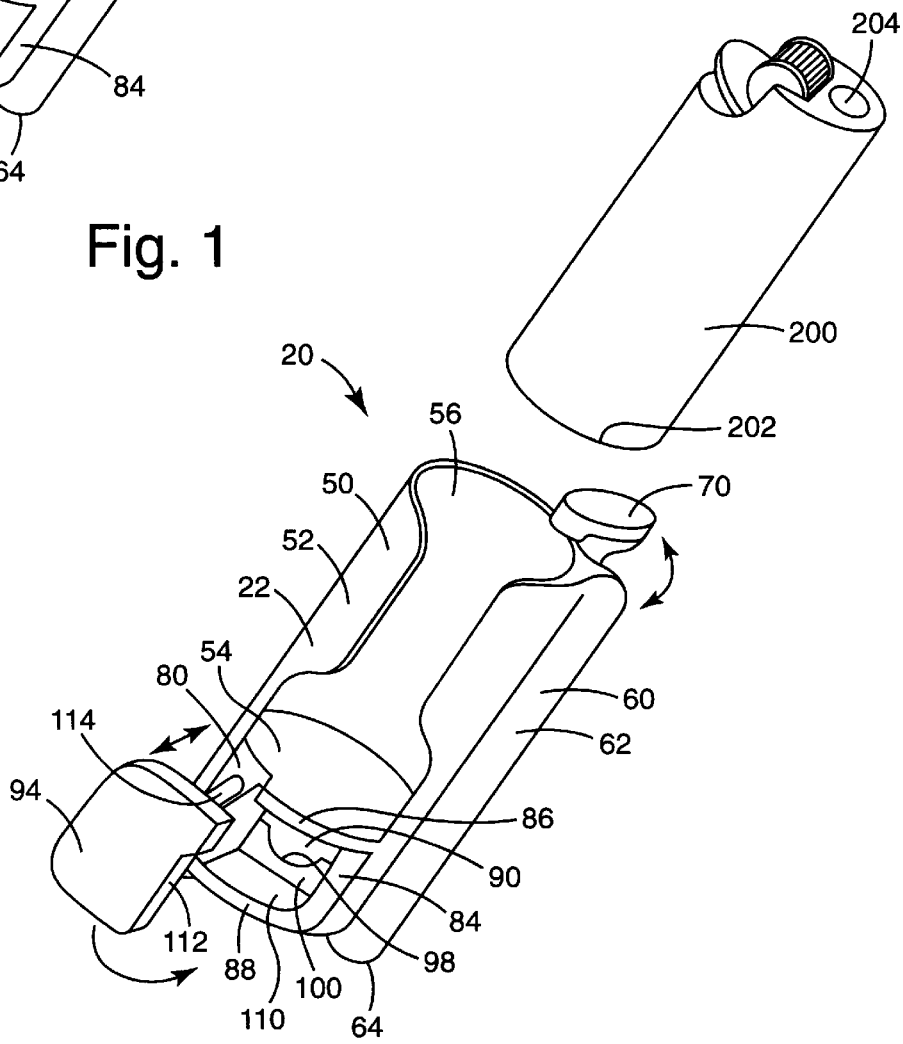
FIG. 2 is a front perspective view of the apparatus of FIG. 1, but wherein the lighter (200) is shown removed, and further wherein the access door (94) of the refuse section (80) and the cap (70) of the rolled tobacco products section (60) are shown in an open state.

Within the housing 22, the lighter section 50 is intended to accommodate a well-known lighter 200, which has a lighter base 202 at one end of its longitudinal axis and a lighter tip 204 at the opposite end from which the lighting flame is emitted. The lighter section 50 is most clearly illustrated in FIG. 2, wherein the lighter 200 is shown removed from the lighter cavity 56. Surrounding the lighter cavity 56, lighter section side walls 52 extend about the longitudinal circumference of the lighter 200 in complimentary fashion so that the lighter 200 can be tightly received therein with a sufficiently close fit that the lighter 200 is restrained from slipping out of the lighter cavity 56, but the lighter 200 may nevertheless be easily removed and replaced when desired. The lighter section side walls 52 provide sufficient clearance about the lighter tip 204 that no significant amount of heat is transmitted from the lighter tip 204 to the lighter section side walls 52, and additionally any flame actuators or other lighter controls at the lighter tip 204 are exposed for easy use. Removal of the lighter 200 can be eased somewhat by partially cutting away the lighter section side walls 52, as FIGS. 1–2 illustrate, but the side walls 52 may continuously extend about some or all of the longitude and circumference of the lighter 200 as desired. A base wall 54 (see particularly FIG. 2) bounds one end of the length of the lighter cavity 56 to provide a surface which the lighter base 202 may abut when the lighter 200 is inserted within the lighter cavity 56. Adjacent the base wall 54 is an openable access door 94 (see particularly FIGS. 1 and 2) —which will be discussed at greater below —which allows access to the interior of the refuse section 80 and which also abuts a portion of the lighter base 202 when the lighter 200 is inserted within the lighter cavity 56. Thus, as FIG. 2 illustrates, a portion of the lighter base 202 is exposed when the access door 94 is opened, and is available for the user to push if the user experiences difficulty in removing the lighter 200 from the lighter cavity 56.

The rolled tobacco products section 60 is best viewed with initial reference to FIGS. 1–4. The rolled tobacco products section 60 includes products section side walls 62 and a products section bottom wall 64 defining a rolled tobacco products cavity 66 (see FIGS. 3 and 5–8) having a opening 68, and a cap 70 which may be disposed over the opening 68 to close the products cavity 66. In the embodiment of the apparatus 20 illustrated in the Figures, the rolled tobacco products cavity 66 is sized to contain a single rolled tobacco product, e.g., a cigarette, and is aligned generally parallel to the lighter cavity 56/lighter 200 in order to conserve space. As is best seen from FIG. 5, the products cavity is also slightly offset from a plane which bisects the lighter cavity 56/lighter 200 and which is also coincident with the major axis of the lighter cavity 56/lighter 200. Conveniently, the lighter section 50 and rolled tobacco products section 60 are aligned so that the user may grasp the apparatus 20 in one hand, open the cap 70 by use of the thumb, lift the apparatus 20 to the lips to receive the rolled tobacco product, and then actuate the lighter 200 using the same hand.

While a removable cap or simple hingedly actuable cap could be used to allow selective access to the products cavity 66, the most preferred embodiment of the apparatus 20 has a hingedly actuable cap which is spring-biased to maintain the products cavity opening 68 closed until the cap 70 is pushed away from the opening 68, and which then closes the opening 68 when the pushing force is removed. With reference to FIGS. 5–8, a passage 24 is defined in the housing 22 adjacent the lighter section side walls 52 surrounding the lighter cavity 56. A spring 26 (shown in FIG. 7) may be disposed in the passage 24 and a first spring end 28 distant from the opening 68 may be anchored against rotational movement by use of an anchoring means. In the preferred embodiment of the apparatus 20, this anchoring means takes the form of an anchoring member 30 which inserts within the coils of the spring 26 and which provides a corrugated surface 32 at the first spring end 28 which mates with a cutting blade 96 in the cutting door 92 in complimentary fashion (as will be discussed at greater length below). This restrains the spring 26 from rotational movement once the anchoring member 30 is affixed to the spring 26 by brazing or other forms of affixment. A pivot rod 34 is similarly affixed to a second end 36 of the spring 26 closest to the opening 68, and the pivot rod 34 similarly provides a corrugated surface 38 at the second end 36 of the spring 26.

Figure 4:
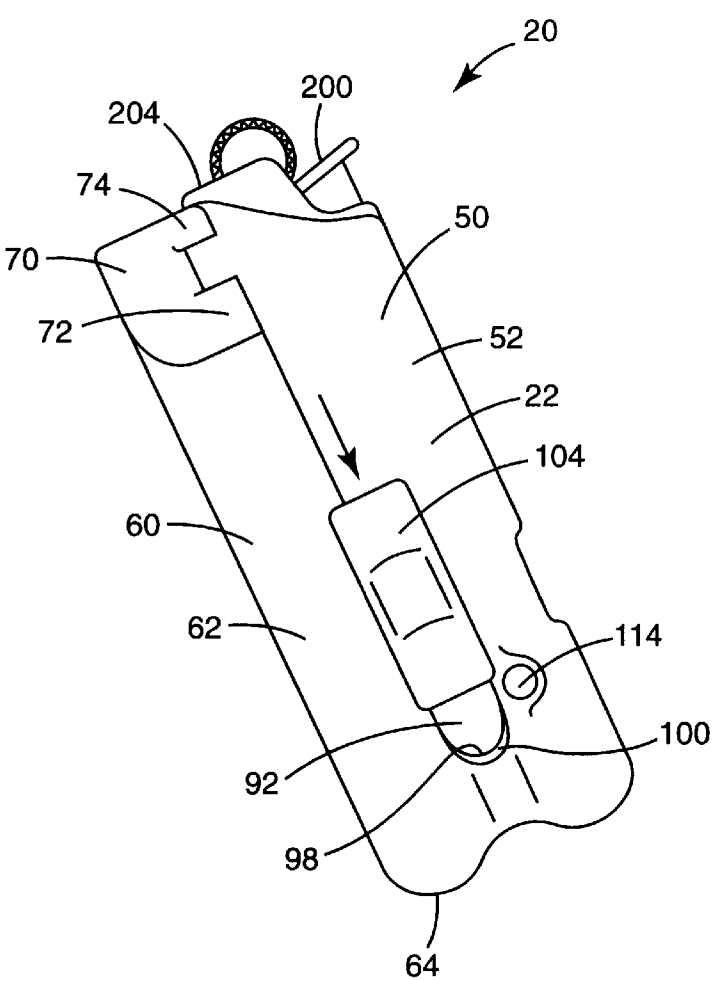
FIG. 4 is a rear perspective view of the apparatus of FIGS. 1–3 wherein the cutting door (92) and the cap (70) of the rolled tobacco products section (60) are shown in a closed state.
Figure 3:
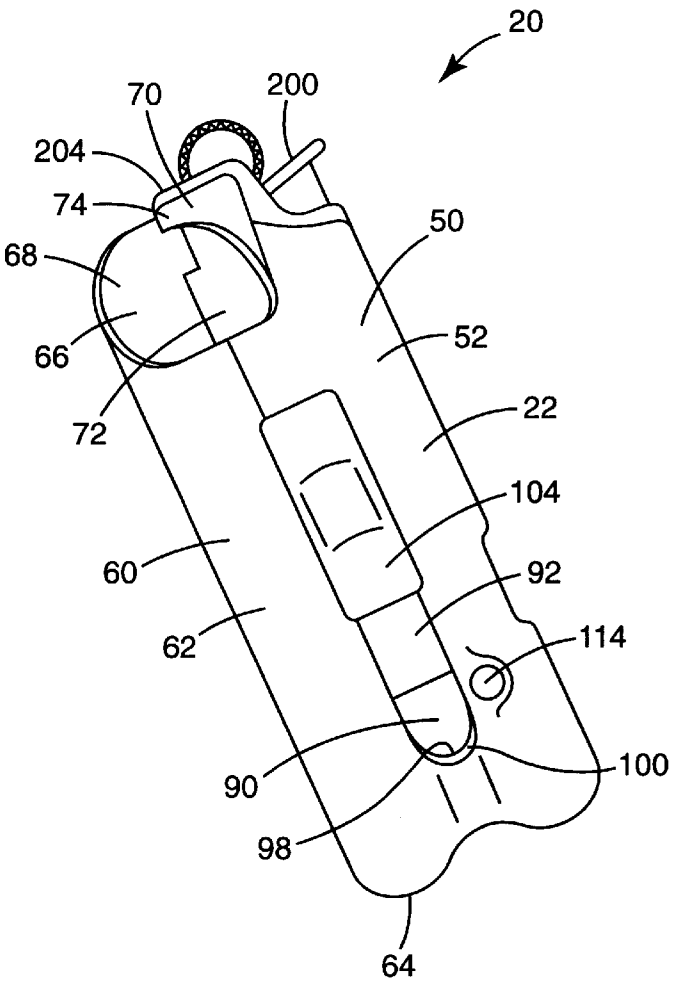
FIG. 3 is a rear perspective view of the apparatus of FIGS. 1–2 wherein the cutting door (92) and the cap (70) of the rolled tobacco products section (60) are shown in an open state.
Figure 5:
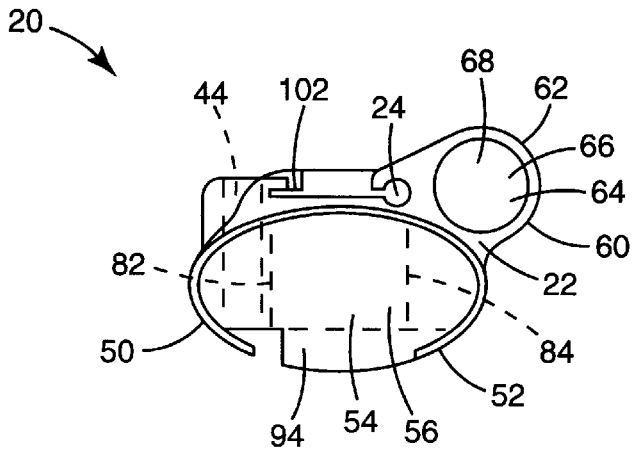
FIG. 5 is a partial top plan view of the apparatus of FIGS. 1–4.
Figure 6:
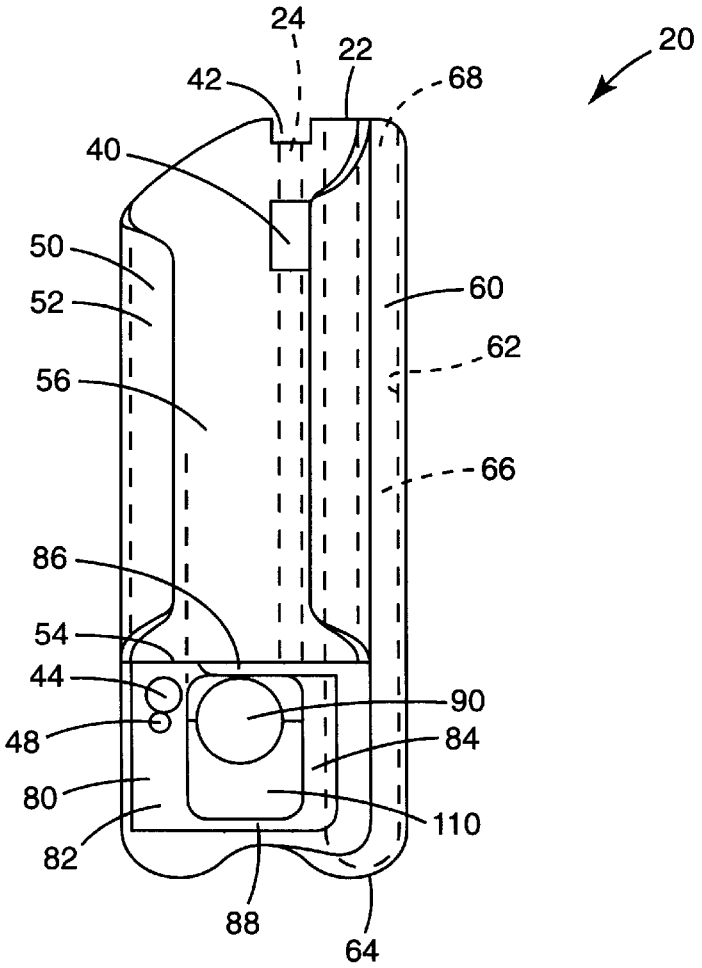
FIG. 6 is a partial front elevation view of the apparatus of FIGS. 1–5.
Figure 7:
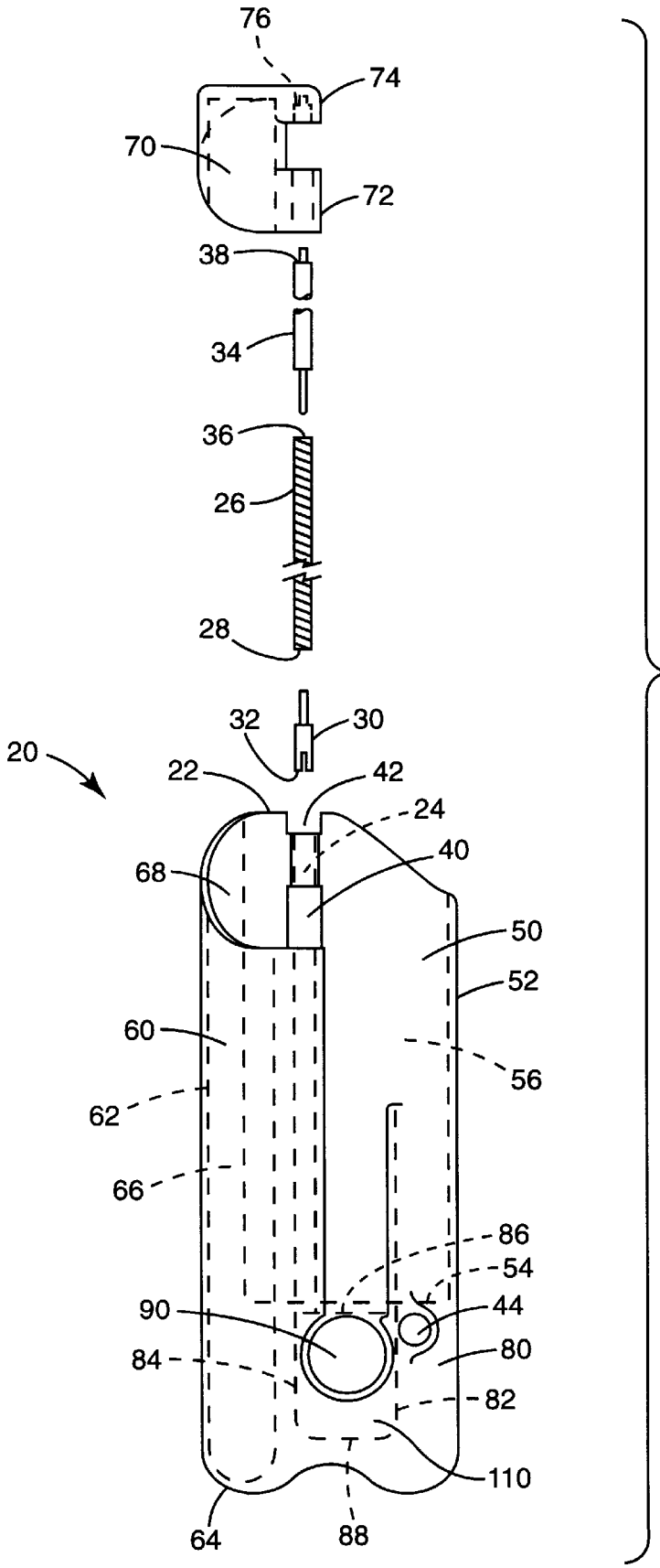
FIG. 7 is an exploded partial rear elevation view of the apparatus of FIGS. 1–6.
Figure 9:
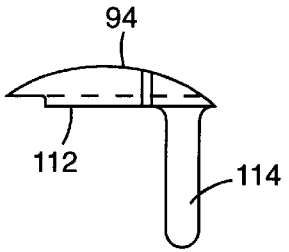
FIG. 9 is a top plan view of the access door (94) of FIGS. 1, 2, and 8.
Figure 10:
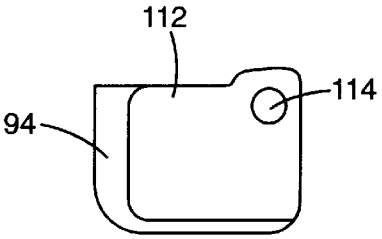
FIG. 10 is a rear elevation view of the access door (94) of FIGS. 1, 2, 8, and 9.
Figure 8:
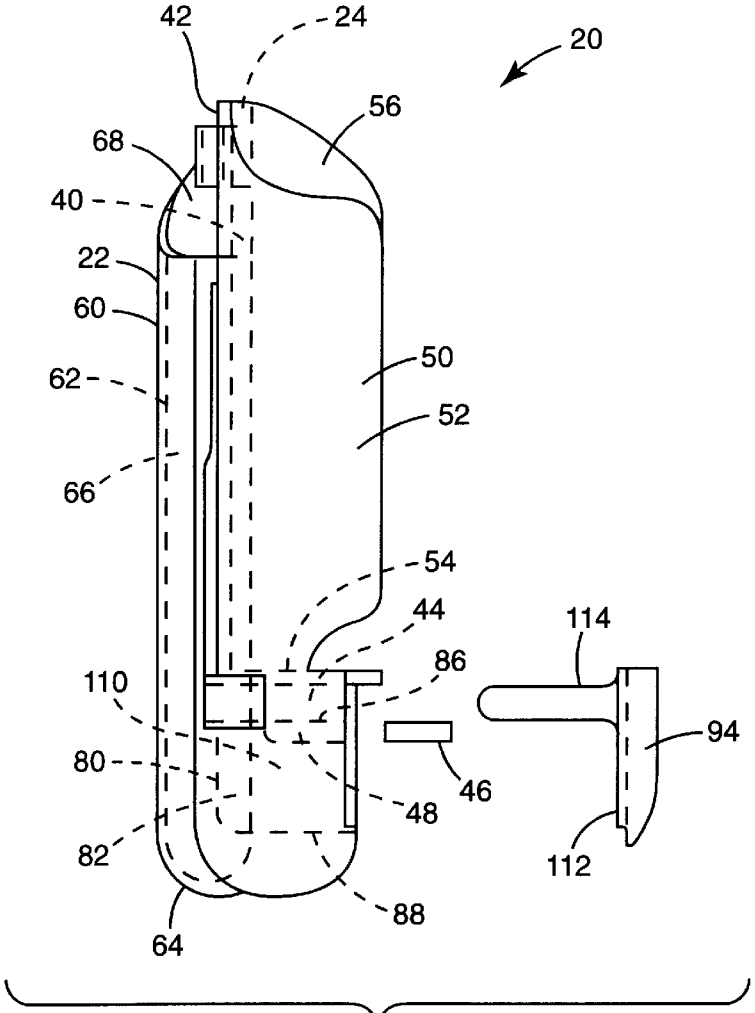
FIG. 8 is an exploded partial side elevation view of the apparatus of FIGS. 1–7.

The cap 70 is then provided with first and second collet members 72 and 74 at its side, the first collet member 72 non-fixably receiving the pivot rod 34 therein and the second collet member 74 having a corrugated interior surface 76 complimentary to the corrugated surface 38 at the end of the pivot rod 34 to fixably receive the end of the pivot rod 34. As is best seen with reference to FIGS. 3, 4, 6, and 7, portions of the housing 22 along the passage 24 are cut away to provide a first aperture 40 for receiving the first collet member 72 and a second aperture 42 for receiving the second collet member 74. Thus, the spring 26 (and its associated anchor member 30 and pivot rod 34) may be inserted within the passage 24 and the spring 26 may be compressed so that the corrugated surface 38 of the pivot rod 34 clears the first aperture 40. The first and second collet members 72 and 74 may then be inserted within their respective first and second apertures 40 and 42, and decompression of the spring 26 then causes the pivot rod 34 to move upwardly into the collet members 72 and 74 until its corrugated surface 38 engages and locks within the corrugated interior surface 76 of the second collet member 74. The cap 70 is thus restrained atop the products cavity 66 with the spring 26 serving as a torsion spring to maintain the cap 70 in a closed position over the products cavity 66 (as illustrated in FIGS. 1 and 4). By pushing the cap 70 sideways, it may be pivoted open about the pivot rod 34 as illustrated in FIGS. 2 and 3.

The refuse section 80 of the housing 22 is best visualized with reference to FIGS. 1, 2, and 6–8. The refuse section side walls 82 and 84 and refuse section top and bottom walls 86 and 88 define the clipping aperture 90 adjacent the base wall 54 of the lighter cavity 56. Ideally, the sizing of the walls 82 and 84 of the clipping aperture causes the refuse section 80 and lighter section 50 combined to occupy roughly the length of a standard rolled tobacco product (e.g., cigarette). For a highly space-efficient arrangement, it is also preferable that the refuse section side walls 82 and 84 be generally contiguous with the lighter section side walls 52 so that the refuse section 80 in general rests at least substantially within the boundaries of the extended lighter section side walls 52 (i.e., so that the refuse section 80 rests wholly or in substantial part within the boundaries of said lighter section side walls 52 if they were extended longitudinally along the axis of lighter 200). In this manner, the refuse section 80 appears to exist as an extension of the lighter section 50 and it does not have the "look and feel" of occupying significant additional space. Preferably, at least one side of the clipping aperture 90 is bounded by a sharp edge 98, and in the apparatus 20 illustrated in the Figures this is done by inserting a sharpened metal wedge 100 into a slot 102 in the housing 22 (best seen in FIG. 5) so that the wedge 100 partially closes the clipping aperture 90, with its sharp edge 98 exposed. The cutting door 92 includes the sharp cutting blade 96 and additionally includes a finger actuator 104. The cutting blade 96 of the cutting door 92 may thus be moved by use of the finger actuator to close the clipping aperture 90 so that the sharpened edge of the cutting blade 96 abuts the wedge 100 to shear and cut any rolled tobacco products inserted within the clipping aperture 90 (see particularly FIGS. 3 and 4). As is best seen from FIG. 14, the cutting blade 96 is configured to slidably fit within the slot 102 (again refer to FIG. 5) so that the cutting blade 96 is movably attached to the housing 22 and is constrained to slidably move over the clipping aperture 90 and thereby open and close the clipping aperture 90. The cutting blade 96 also includes a receiving surface 106 upon which the anchoring member 30 is received when the spring 26/pivot rod 34/anchoring member 30 combination is inserted within the passage 24 in the housing 22, as discussed above. Thus, when the first and second collet members 72 and 74 of the cap 70 are inserted within the apertures 40 and 42 in the housing 22 to restrain the longitudinal motion of the spring 26 and to bias the cap 70 closed, the spring 26 also biases the cutting blade 96 to maintain the clipping aperture 90 in a normally closed state.

The finger actuator 104 is then illustrated in FIGS. 11–13 at various angles. The finger actuator 104 is preferably affixed to the cutting blade 96 by extending screws through apertures 108 in the cutting blade 96 (see FIG. 14) and into the finger actuator 104, though other means of affixment may be used instead. As noted above, and as shown particularly in FIG. 5, the walls 62/64 of the rolled tobacco products section 60 are slightly offset from the width-wise axis of the lighter section 50 so that a slight concavity is formed between the rolled tobacco products section 60 and the lighter section 50. As is best shown by FIGS. 3 and 4, the cutting door 92 (i.e., the finger actuator 104 and cutting blade 96) slides within this concavity. This helps to save space and also helps deter inadvertent actuation of the cutting door 92 within a purse or pocket owing to contact of a protruding finger actuator 104 with other objects. Significant space savings is also achieved by constraining the cutting door 92 to move generally parallel to the housing 22, and additionally by movably attaching the cutting door 92 within the housing 22 with its path of travel extending outside of the refuse section 80 and adjacent the rolled tobacco products section 60 and the lighter section 50 because no significant additional space beyond that which is already occupied by the product section, lighter section 50, and refuse section 80 is utilized to accommodate the cutting mechanism.

Adjacent the clipping aperture 90, the refuse section side walls 82 and 84 and top and bottom walls 86 and 88 are preferably closed so as to define a refuse cavity 110 within the refuse section 80 wherein cut portions of rolled tobacco products may be stored. An immobile wall may be used to close the refuse cavity 110, but as will be discussed below and as is illustrated in FIG. 2, the refuse cavity 110 is preferably closed by the openable access door 94 in the refuse section 80 to allow easier access to the refuse cavity 110. In either case, refuse may be emptied from the refuse cavity 110 by actuating the finger actuator 104 to open the clipping aperture 90, and then simply emptying the refuse through the clipping aperture 90. The spring-biasing of the cutting door 92 to maintain the clipping aperture 90 in a normally closed state is advantageous because it will prevent the inadvertent emptying of refuse into the user's pocket or purse.

However, emptying of the refuse cavity 110 is significantly eased if the aforementioned access door 94 is used to close the refuse cavity 110 rather than an immobile wall. As illustrated in FIG. 2, it is preferable to have the aforementioned access door 94 comprise an entire wall of the refuse cavity 110 so that access to the entirety of the refuse cavity 110 is provided, thereby allowing more thorough emptying and cleaning of the refuse cavity 110. The access door 94 preferably includes a land 112 which fits within the perimeter of the refuse cavity 110 in complimentary fashion, and a door pin 114 extending into a pin passage 44 in the housing 22 adjacent the refuse cavity 110 and extending from the opposite side of the housing 22 (see particularly FIGS. 5–8). Thus, when the access door 94 is closed as illustrated in FIG. 1, the door pin 114 extends slightly from the opposite side of the housing 22 as illustrated in FIGS. 3 and 4. The door pin 114 fits so closely within the pin passage 44 that it is resistant to longitudinal or rotational motion within the pin passage 44. This tight fit may either be provided by use of a close friction fit, or as illustrated particularly in FIGS. 6 and 8, a rubber insert 46 may be inserted within an insert passage 48 adjacent the pin passage 44 so that the insert bears against the door pin 114 to inhibit its motion. By pushing on the end of the door pin 114 illustrated in FIGS. 3 and 4, the access door 94 will be moved slightly out of engagement with refuse section side walls 82/84 and top and bottom walls 86/88 just so much as to form a crack between the access door 94 and the refuse section walls, but not so much as to move the land 112 out of the refuse cavity 110. With this crack formed, the user may grasp access door 94 to pull it outwardly from the refuse cavity 110 in the direction of the longitudinal axis of the door pin 114 until the land 112 clears the refuse section walls 82/84/86/88. The access door 94 may then be swung about the axis of the door pin 114 into the position illustrated in FIG. 2 to allow access to the refuse cavity 110. Since the refuse cavity 110 will contain tobacco particles and burnt and odiferous matter such as ashes and semi-burnt tobacco (and perhaps even butts of smoked tobacco products if the refuse section 80 is also used as an ashtray), it is desirable to make the refuse cavity 110 as resistant as possible to inadvertent opening within one's pocket or purse. The access door 94 of FIG. 1 is resistant to inadvertent opening in that the use of the land 112 and pin 114 requires motion in two degrees of freedom to gain access to the refuse cavity 110.

The apparatus 20 is preferably made of plastic, though it may instead be made of cast or machined metal or ceramic material. It has a particularly attractive appearance when made of cast gunmetal or machined stainless steel, and has the appearance of a precision instrument, as well as impressive heft in the hand. If made of metal, it is also an attractive option to integrally form a refillable lighter in place of the lighter cavity 56 of the apparatus, though this may be done when the apparatus 20 is made of other materials as well. The use of metal also makes the apparatus 20 attractive for monogram engraving, jewelled insets, and other types of decoration popular in the jewelry arts.

It is notable that the cutting door 92 of the refuse section 80, when provided in the same or similar form as that shown and described above, is believed to operate in a far superior manner to any prior devices when used to cut off the burning portion of a rolled tobacco product to recondition the product for later relighting and smoking. It is known to smokers that relighting of a stubbed-out rolled tobacco product typically renders the product foul-tasting and generally unsuitable for smoking when it is later relit. The same effect occurs when rolled tobacco products are extinguished by inserting them into elongated cavities so that their burning portions consume their surrounding air supply, or by inserting them within such elongated cavities having cutting devices therein. In contrast, the cutting door 92 and refuse section 80 described above has been found to recondition rolled tobacco products with substantially reduced deterioration in taste and smell. While the precise reason for this improved performance is not known, it is believed to arise because prior to and during cutting, the apparatus 20 provides lit rolled tobacco products with an adequate oxygen supply at all times. The reconditioned portions of the rolled tobacco products are never placed in proximity to materials burning in an atmosphere with an incomplete oxygen supply. It is believed that in the prior art devices, the rolled tobacco products are extinguished in an atmosphere having depleted oxygen, thereby leading to incomplete combustion and the release of foul-tasting and foul-smelling particles which may be absorbed by the reconditioned portion of the rolled tobacco products. Referring particularly to FIGS. 3 and 4, it is evident that when rolled tobacco products have their burning portions inserted within the clipping aperture 90 for removal by shutting the cutting door 92, the rolled tobacco products will at all times be in a substantially open-air environment, and thus the portion to be reconditioned will never be situated nearby materials undergoing incomplete combustion. The burning particles are then retained and rapidly suffocated within the closed refuse cavity 110, which is resistant to the release of odors, and the reconditioned portion of the rolled tobacco product may be retained within the rolled tobacco products section 60. Because the reconditioned rolled tobacco product has no significant deterioration in taste and odor, it is no longer objectionable to relight reconditioned products.

The apparatus 20 is also useful when a user is attempting to quit smoking. The user can smoke just so much of a cigarette to satisfy a nicotine craving, then cut off the burnt end using the cutting door 92 and place the remainder of the cigarette in the rolled tobacco products cavity 66. The remainder of the cigarette can then later be removed and relit for use, and again only so much can be smoked as is necessary to satisfy a craving. In this manner, use of a single cigarette can be extended to take the place of several, and one's total cigarette consumption will overall be decreased.

While the apparatus 20 is illustrated and described above as being particularly suited for use with rolled tobacco products such as cigarettes, it is easily adaptable by one of ordinary skill for use with cigars. It is understood that the various preferred embodiments are shown and described above to illustrate different possible features of the invention and the varying ways in which these features may be combined. Apart from combining the different features of the above embodiments in varying ways, other modifications are also considered to be within the scope of the invention. Following is an exemplary list of such modifications.

First, if desired, the cutting blade 96 and finger actuator 104 may be omitted from the clipping aperture 90 and replaced with a wall, and the access door 94 can be used to serve as the cutting door. This can be done by providing the clipping aperture 90 with a sharp edge provided on the refuse section side walls 82/84 and/or top or bottom wall 86/88 of the refuse cavity 110, and/or on the edge(s) of the access door 94 adjacent the clipping aperture 90, so that closing of the access door 94 on a rolled tobacco product will cut it.

Second, the means for allowing the cap 70 to pivot away from the rolled tobacco products cavity 66 may not be provided in the exact form shown, and for example the pivot rod 34/anchor member 30 could be deleted if the spring 26 is attached directly to the cap 70, cutting blade 96, and/or housing 22. Different torsion and compression members apart from a helical spring may be used. Further, separate torsion and compression members could be provided to separately actuate the cap 70 and the cutting blade 96.

Third, as noted above, both the cutting blade 96 and the wedge __ are described as including sharp edges. It is understood that only one of the cutting blade 96 and the wedge 100 need bear a sharp edge since closure of the cutting blade 96 will in any case force the rolled tobacco product against a sharp edge to sever the rolled tobacco product. However, the use of a sharp edge on both the cutting blade 96 and the wedge 100 helps to insure that an especially clean cut is created. Further, while the preferred apparatus 20 causes the cutting blade 96 and the wedge 100 to travel alongside each other to cut the rolled tobacco product, direct edge-to-edge meeting of the cutting blade 96 and wedge 100 is also possible. It is also possible to eliminate the wedge 100 entirely and to simply have the sharp edge of the cutting blade 96 bear down on the rolled tobacco product with the bottom wall 88 of the refuse section 80 restraining the rolled tobacco product from movement.

Fourth, the aforementioned arrangement and dimensioning of the lighter section 50, rolled tobacco products section 60, and refuse section 80 (including the cutting door 92/104) are believed to provide a particularly convenient and space-efficient arrangement of elements which is well suited for one-handed use of the various sections and easy storage. However, the various elements of the apparatus 20 can in some cases be differently dimensioned and/or rearranged in various fashions without significant adverse effects on the advantages of the preferred embodiment of the invention. As an example, if desired, the rolled tobacco products section 60 may be made slightly longer so that its cap 70 is roughly flush with (or extends slightly beyond) the tip of the lighter.

This may be desirable if carrying the apparatus 20 within a pocket or purse and contact with the lighter tip 204 is undesirable owing to the possibility of inadvertent actuation or potential catching of the lighter tip 204 on the interior of the purse or pocket. As another example, the refuse section 80 could have a larger size and could rest intermediate the lighter section 50 and rolled tobacco products section 60. The refuse cavity 110 may then be sized so that when the access door 94 is open, the refuse cavity 110 may be used as an ashtray if desired so that ashes or leftover smoking materials can be retained for later disposal without escape of odors.

Fifth, it is possible to have the rolled tobacco products cavity 66 be sized to contain more than a single rolled tobacco product. As an example, the products cavity 66 may be sized large enough to contain up to 5 cigarettes. The user can then carry the apparatus 20, rather than an entire pack of cigarettes, to limit the amount of cigarettes available for smoking.

The invention is not intended to be limited to the preferred embodiments described above, but rather is intended to be limited only by the claims set out below. Thus, the invention encompasses all alternate embodiments that fall literally or equivalently within the scope of these claims. It is understood that in the claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

What is claimed is:

1. An apparatus comprising:

a. a lighter extending lengthwise between a lighter base and an opposing lighter tip, wherein the lighter may be actuated to emit flame from the lighter tip;

b. a housing including walls defining:

(1) a refuse cavity adjacent the lighter base, the refuse cavity having a clipping aperture defined therein, the clipping aperture being at least partially bounded by a sharp edge, (2) an elongated lighter cavity wherein the lighter base is removably inserted, c. a cutting door movably attached to the housing, the cutting door being constrained to move over the clipping aperture, thereby opening and closing the clipping aperture, whereby closing the cutting door on a rolled tobacco product inserted within the open clipping aperture forces the rolled tobacco product against the sharp edge, thereby cutting the rolled tobacco product with a portion of the rolled tobacco product being received within the refuse cavity.

2. The apparatus of claim 1 wherein the cutting door is spring-biased to maintain the clipping aperture in a normally closed state.

3. The apparatus of claim 1 wherein the sharp edge is situated on the cutting door.

4. The apparatus of claim 1 wherein the cutting door is constrained by the housing to slide along a path situated along at least a portion of the length of the lighter.

5. The apparatus of claim 1 wherein the housing further includes walls defining an elongated substantially tubular rolled tobacco products cavity extending adjacent to the lighter cavity, the length of the rolled tobacco products cavity being aligned generally parallel to the lighter cavity.

6. The apparatus of claim 5 further comprising a cap movably affixed to the housing adjacent the walls defining the rolled tobacco products cavity, the cap being movable to open and close the rolled tobacco products cavity, the cap being biased to normally close the rolled tobacco products cavity.

7. The apparatus of claim 6 wherein the cap is biased by a spring, and wherein the spring also biases the cutting door over the clipping aperture.

8. The apparatus of claim 5 wherein the cutting door slides between the walls defining the lighter cavity and the walls defining the rolled tobacco products cavity.

9. The apparatus of claim 5 wherein the housing further includes walls defining a refuse cavity adjacent the clipping aperture, whereby cuttings from rolled tobacco products cut by the cutting door are received within the refuse cavity.

10. The apparatus of claim 1 wherein the walls defining the refuse cavity include an access door opening onto the refuse cavity, the access door being spaced from the cutting door.

11. The apparatus of claim 1 wherein:

the access door includes an access door pin extending therefrom and into the housing to terminate in an exposed end, the access door pin being slidable with respect to the housing to bring the access door into and out of engagement with the walls defining the refuse cavity, and the access door pin also being rotatable with respect to the housing to swing the access door away from the refuse cavity, the exposed end of the access door being pushable to move the door out of engagement with the walls defining the refuse cavity.

12. An apparatus comprising:

a. a housing including an elongated lighter cavity, an elongated rolled tobacco products cavity, and a refuse cavity defined therein, wherein the lighter cavity and rolled tobacco products cavity are generally parallel and the refuse cavity is situated along a lengthwise axis of the lighter cavity, and b. a cutting door opening onto the refuse cavity to define a clipping aperture, the clipping aperture being at least partially bounded by a sharp edge, whereby closing the cutting door on a rolled tobacco product inserted within the open clipping aperture forces the rolled tobacco product against the sharp edge, thereby cutting the rolled tobacco product;

c. an access door movably attached to the housing and opening onto the refuse cavity, the access door being spaced from the cutting door.

13. The apparatus of claim 12 wherein the cutting door is slidably mounted between the lighter cavity and the rolled tobacco products cavity.

14. The apparatus of claim 5 wherein the rolled tobacco products cavity has a products cavity opening located at one end of its length.

15. The apparatus of claim 14 wherein the products cavity opening is substantially circular.

16. The apparatus of claim 1 wherein:

the lighter cavity has a lighter cavity opening located at one end of its length;

the housing further includes walls defining an elongated rolled tobacco products cavity extending generally parallel to the lighter cavity, the rolled tobacco products cavity having a products cavity opening located at one end of its length;

and wherein the lighter cavity opening and products cavity opening are situated adjacently on the housing.

17. The apparatus of claim 16 wherein the rolled tobacco products cavity extends adjacently along both the refuse cavity and the lighter cavity.

18. The apparatus of claim 16 wherein the cutting door slides between the walls defining the lighter cavity and the walls defining the rolled tobacco products cavity.

19. The apparatus of claim 13 wherein the cutting door includes an actuator button affixed thereon, the actuator button being slidably mounted between the lighter cavity and the rolled tobacco products cavity.

20. The apparatus of claim 12 wherein the access door is situated at least substantially opposite the cutting door.

21. An apparatus comprising:

a. a housing including an elongated lighter cavity, an elongated rolled tobacco products cavity, and a refuse cavity defined therein, wherein the lighter cavity and rolled tobacco products cavity are generally parallel and the refuse cavity is situated along a lengthwise axis of the lighter cavity, and b. a cutting door opening onto the refuse cavity to define a clipping aperture, the clipping aperture being at least partially bounded by a sharp edge, the cutting door being slidably mounted to slide between the lighter cavity and the rolled tobacco products cavity and generally parallel to their lengths, whereby closing the cutting door on a rolled tobacco product inserted within the open clipping aperture forces the rolled tobacco product against the sharp edge, thereby cutting the rolled tobacco product.

22. The apparatus of claim 21 further comprising an access door movably attached to the housing and opening onto the refuse cavity, the access door being spaced from the cutting door.

* * * * *